US005605183A

United States Patent [19]

Hartman et al.

[11] Patent Number: 5,605,183

[45] Date of Patent: Feb. 25, 1997

[54] MULTI-FLAVOR DISTRIBUTION DECK FOR POUCH PACKAGING MACHINE

[75] Inventors: Donn A. Hartman, Gurnee; Thomas E. Cloud, Glenview, both of Ill.

[73] Assignee: Cloud Corporation, Des Plaines, Ill.

[21] Appl. No.: 573,872

[22] Filed: Dec. 18, 1995

Related U.S. Application Data

[63] Continuation of Ser. No. 314,886, Sep. 29, 1994, abandoned.

[51] Int. Cl.[6] ..... B65B 1/00

[52] U.S. Cl. ..... 141/237; 141/9; 141/100; 141/129; 141/145

[58] Field of Search ..... 141/9, 100, 101, 141/129, 144, 145, 234, 240, 236–238, 331–334, 340–342; 53/202, 284.7

[56] References Cited

U.S. PATENT DOCUMENTS

| | | | |
|---|---|---|---|
| 2,054,279 | 9/1936 | Briggs | 141/144 X |
| 2,387,585 | 10/1945 | Howard | 141/129 X |
| 2,667,997 | 2/1954 | Vogt | 53/202 X |
| 2,671,587 | 3/1954 | Vogt | 53/202 X |
| 2,671,588 | 3/1954 | Vogt | 141/237 X |
| 3,597,898 | 8/1971 | Cloud | 53/562 |
| 5,082,032 | 1/1992 | Crocker | 141/144 X |

FOREIGN PATENT DOCUMENTS

| | | | |
|---|---|---|---|
| 0372239 | 11/1963 | Switzerland | 141/144 |

*Primary Examiner*—J. Casimer Jacyna

*Attorney, Agent, or Firm*—Dorn, McEachran, Jambor & Keating

[57] ABSTRACT

A pouch packaging machine has a rotary filling head wherein pouches receive diverse fluent products from filling tubes. Adjacent filling tubes, and therefore adjacent pouches, are supplied with alternating flavors of products by a distribution deck having a separate channels for each flavor desired. The channels empty into a series of funnels attached beneath the deck. The funnel spouts are aligned with inlets to the filling tubes. The mouths of the funnels span substantially the entire channel to allow sufficient time for the product to pass from a supply device, through the channels, funnels and filling tubes and into a pouch before the pouch leaves the filling head.

9 Claims, 2 Drawing Sheets

2

92
64C
10
-54-
A
56
92
60
58
52
64B
62
62
48
64A
16
92
2

92
64A
64B
64C
60
10
62
52
90
56
48
54
56
90
58
58
50
58
58
12
26
22
20
30
28
14
32
34
24
44
36
38
46
42
18
42
40
16

MULTI-FLAVOR DISTRIBUTION DECK FOR POUCH PACKAGING MACHINE

This application is a continuation of application Ser. No. 08/314,886 filed on Sep. 29, 1994, now abandoned.

BACKGROUND OF THE INVENTION

This invention relates to a multi-flavor filling head of a high speed pouch packager. Pouches are used for a variety of dry or liquid products such as sugar, sweeteners, salt, creamers, drink mixes, soup mixes and the like. Examples of basic pouch forming and filling machines are shown in U.S. Pat. Nos. 3,344,576, 3,453,799 and 3,667,188, the disclosures of which are incorporated herein by reference. These patents show how a continuous web of pouch material is folded, sealed on two sides, filled through the open top, sealed on top and then severed into individual, filled pouches. The severed pouches are fed to a stacker or cartoner.

The described pouch-forming operations begin at a feeder for supplying a continuous web of pouch material. The feeder typically includes a plow for folding the web. The folded web goes to a vertical heat sealer which forms spaced side seals. The side seals define a series of pouches having an open top. The open pouches go to a filling wheel for filling with a product through the open top of the pouch. Then a top sealer closes the top edge of the filled pouches, and a knife severs them into individual pouches or groups of pouches with or without perforations between them.

In the past high speed machines have typically packaged a single product in sequential pouches which are cut into individual, single pouches or groups of two, three or more pouches with perforations between them. The desire to be able to make multiple flavor packs has been longstanding. These are used as display packs, samplers and variety packs in bags or cartons. In such a pack, sometime called a multi-flavor pack, the products in sequential pouches are not the same. For example, a three-pouch pack might contain a vanilla, chocolate and strawberry flavored drink mix. In the past packaging multiple flavors required either machinery dedicated solely to this task, multiple machines or, at best, difficult and time-consuming handling and scheduling logistics. Even the basic variety pack (multiple flavors in individual pouches supplied in a common wrapper) required that a machine produce one of the flavors and store the finished pouches, clean and change over the machine for the next flavor, run the next flavor, store those pouches and so on; later, all the flavors would have to be counted and combined by hand.

The only alternative to this would be using, for example, three machines, and running them simultaneously into custom collation equipment for counting and combining the output from the machines. This is, of course, very costly and less efficient in that when one machine is unable to run, the entire line is shut down. There are machines that will package two flavors at the same time, but they are not in the high speed realm. They also cannot leave the pouches perforated together and could never change between two and three flavors.

SUMMARY OF THE INVENTION

This invention concerns pouch packaging machine having a rotary product filling wheel with an improved multi-flavor distribution deck. The distribution deck enables formation of multi-flavor packs without alteration of the rest of the packaging line, including the standard filling wheel. The deck runs at high speed and can be used with two or three flavors, or potentially more if more channels and funnel series are provided. The distribution deck of the present invention works effectively even with products whose flow characteristics make them difficult to handle, such as products with a higher fat content.

The distribution deck includes a circular plate mounted above the filling wheel for rotation with the wheel. At least two concentric, open-top channels are defined by vertically upstanding walls attached to the plate. Openings in the plate between the walls allow product supplied to the distribution deck to fall through the channels into one of a series of arcuate funnels. There is a series of funnels for each channel. The funnels are mounted on the underside of the plate. Each funnel has walls defining a mouth at the upper end and a spout at the lower end. The mouth is in fluid communication with the opening at the bottom of the channel while the spout is aligned with the conical inlet of a product feed tube in the filler wheel. The funnel mouths of a series occupy substantially all of its channel, i.e., there is no significant land or shelf between successive funnels. A product supply means is mounted above the plate for metering a desired amount of a different product to each of the channels.

DETAILED DESCRIPTION OF THE INVENTION

Figure 1:
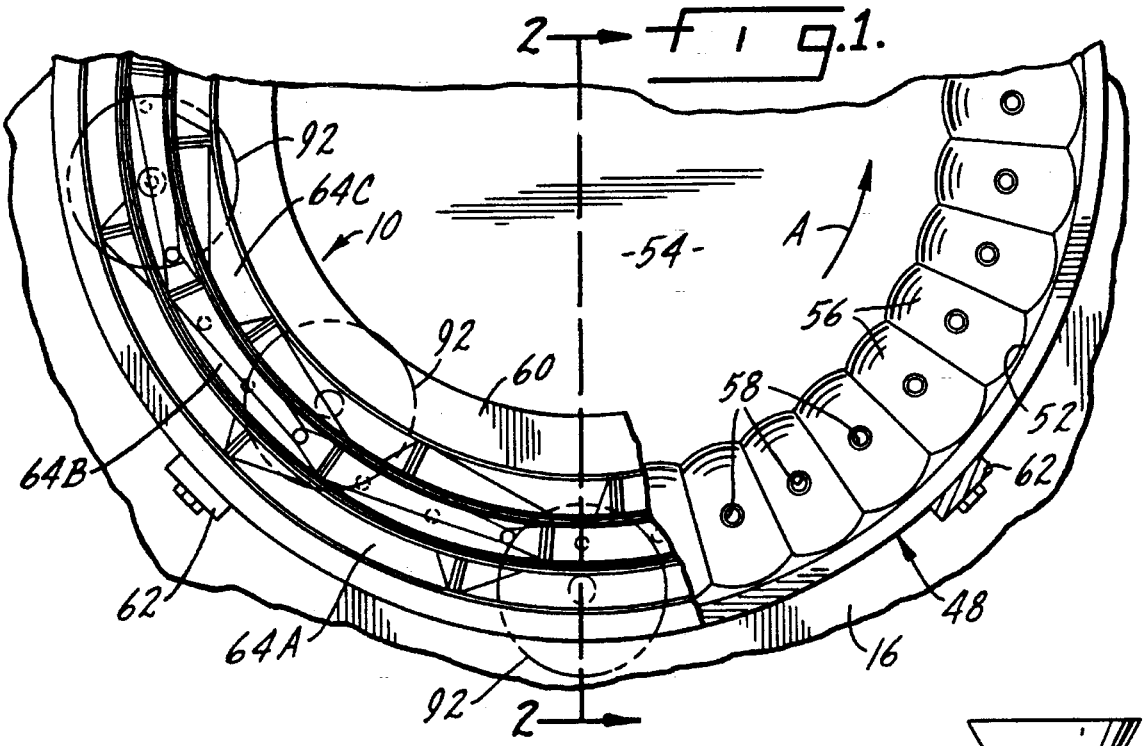
FIG. 1 is a plan view of the multiple flavor distribution deck of the present invention, with portions cut away to show the filler wheel.
Figure 2:
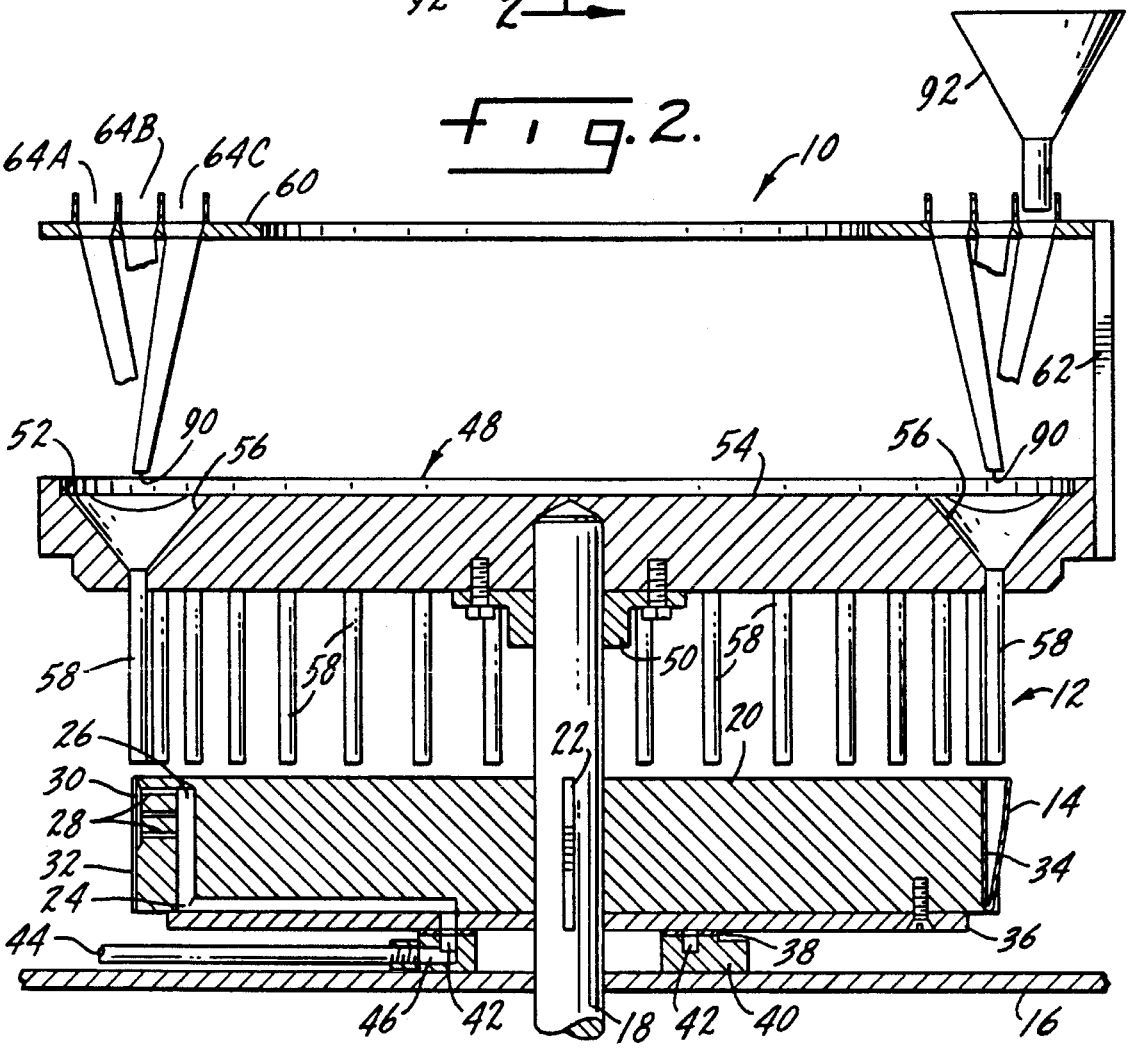
FIG. 2 is a section taken along line 2—2 of FIG. 1.

FIGS. 1 and 2 illustrate the multi-flavor distribution deck 10 of the present invention. The deck is mounted for rotation with a conventional filling wheel 12. Together the distribution deck 10 and the filling wheel 12 comprise the filling head of a pouch packaging machine. The filling head rotates in the direction of arrow A. A pouch is shown at 14 in FIG. 2 at a pouch station, with its top edge open for filling. It will be understood that the pouch 14 is part of a continuous strip of pouches that are supplied to the filling wheel. The packaging machine has a base 16 which houses a drive such as an electric motor (not shown) for a vertical drive shaft 18.

The filling wheel 12 comprises a drum 20 keyed at 22 to the drive shaft 18 for rotation with the shaft. The drum has a plurality of radial vacuum passages 24 on its bottom surface extending to risers 26. The risers 26 communicate with vacuum ports 28 which terminate on the periphery of the drum at depressions 30. The depressions are formed in a flat portion or land 32 of the drum periphery. The lands 32 adjoining concave cylindrical valleys 34. The perimeter of the drum is made up of these alternating, vertically-extending lands 32 and valleys 34 which define pouch receiving stations when a strip of pouches is guided therearound. The distances between the lands are less than the distances between the spaced heat seals on the strip so that one of the panel portions of the strip can collapse into the valleys to facilitate filling of the pouch. The lands and valleys are sized so as to receive the strip after it has been formed into a succession of pouches with the vertical seam or seal held by the vacuum (through depression 30) at lands 32 and the intervening pouch panel portion entering the valley 34.

A vacuum cover plate 36 is bolted to the bottom of the drum 20 to seal off the vacuum passages 24. A gasket 38 is mounted to the bottom of cover plate 36 and rides on the upper surface of a vacuum valve plate 40. Valve plate 40 is mounted to the base 16. The valve plate 40 and gasket 38 have a C-shaped groove 42 centered on the shaft and extending about 300° or so in the upper surface of the plate. A vacuum supply pipe 44 is coupled to an inlet 46 in the valve plate. The inlet communicates with the groove 42 to provide a vacuum source to the passages 24.

Also forming part of the filling wheel 12 is a rotating circular table 48. The table is attached to the drive shaft 18 by a collar 50. The table 48 has an outer peripheral lip 52 encircling its planar upper surface 54. A plurality of conical inlets 56 are formed in the table, one for each valley 34 on drum 20. The inlets funnel downwardly to nozzles 58. The nozzles are positioned so as to be directly over a pouch station of the drum 20, with the lower end of the nozzle feeding into the open edge of a pocket. Together the inlet 56 and nozzle 58 form a product feed tube.

It will be understood that the filling wheel described to this point is conventional. Further details are shown in U.S. Pat. No. 3,597,898, assigned to the present assignee and the disclosure of which is incorporated by reference herein.

The multi-flavor distribution deck 10 of the present invention will now be described. The deck 10 can be substituted for the conventional single product dispenser by attaching it to the table 48. The deck includes a plate 60 mounted for rotation with the filling wheel 12 and table 48 by a central hub or the like. The hub is shown at 62 in FIG. 2. It will be noted that the multi-flavor distribution deck 10 is a removable attachment for a conventional filling head. When it is desired to return the machine to packaging a single product, the deck 10 is removed and the conventional single product dispenser is put back in operation. Thus, one basic machine can be adapted for either single or multiple flavor packs.

Figures 3, 4:
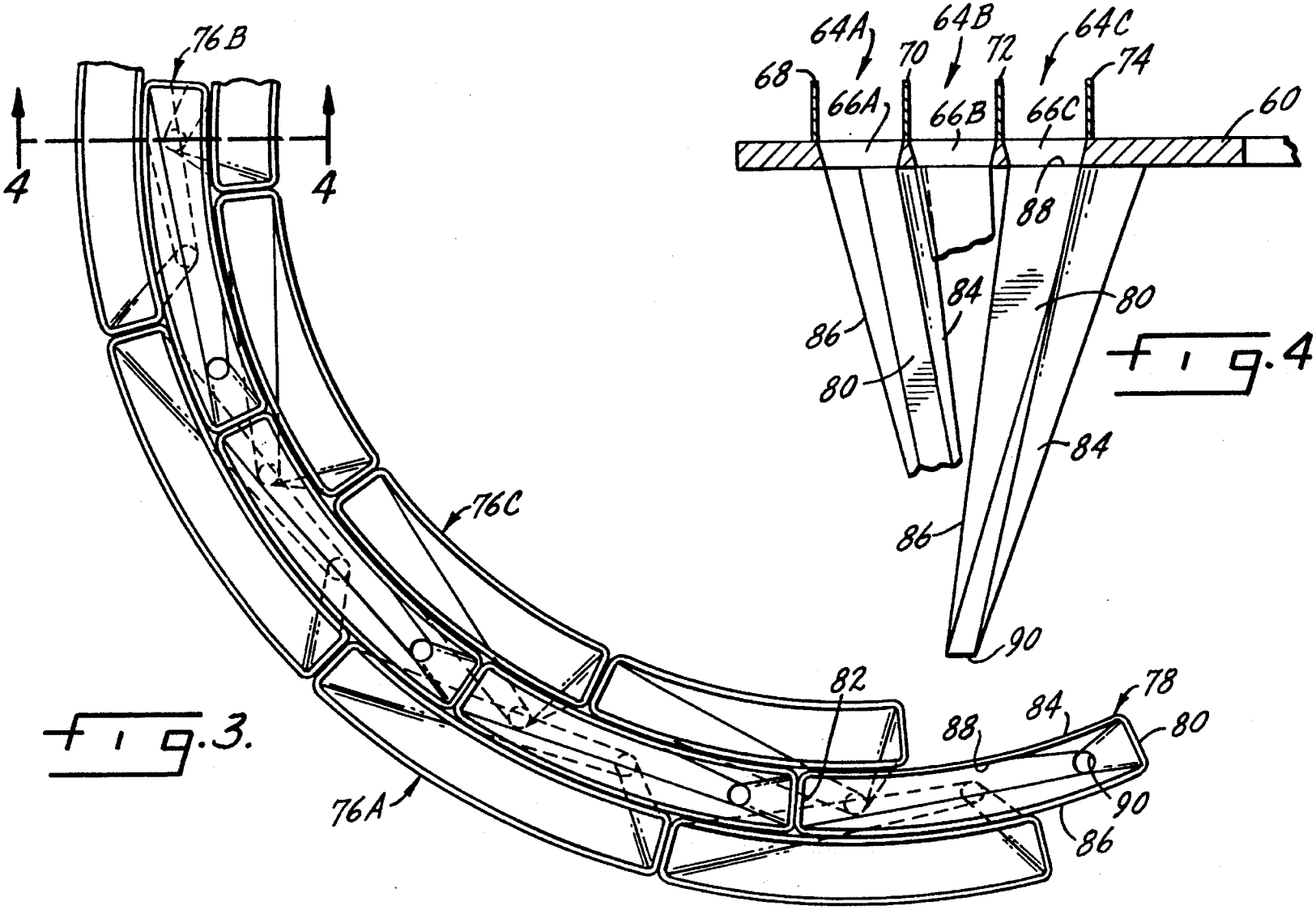
FIG. 3 is a plan view of the funnels, with the plate and channel walls removed.
FIG. 4 is a section taken generally along line 4—4 of FIG. 3, but with the plate and channel walls included.

Three circular, concentric channels or tracks or raceways 64A, 64B and 64C are formed in the plate 60. As best seen in FIG. 4, the channels are defined by openings 66A, 66B and 66C in the plate 60 and by upstanding walls 68, 70, 72 and 74 attached to the plate's upper surface. The interior walls 70 and 72 separate the channels while exterior walls 68 and 74 define the outer and inner limits of channels 64A and 64C, respectively. The walls prevent cross-contamination during the feeding of different products to the different channels. It can be seen that the channels 64 are open at the bottom and top thereof.

The channels empty into a series of arcuate funnels mounted on the underside of the plate 60. As seen in FIG. 3, there is a series of funnels 76A, 76B and 76C for each of the channels. One particular funnel 78 will be described in detail, it being understood that the others are similar. The funnel has a leading wall 80, a trailing wall 82 and inside and outside side walls 84 and 86. Together the walls define a mouth 88 at the upper end and a spout 90 at the lower end. The mouth 88 of each funnel is in fluid communication with the bottom of its channel while the spout 90 is aligned with one of the inlets 56 of a product feed tube.

It will be noted in FIG. 4 that the side walls of the funnels are not only arcuate to conform to the curvature of the channels, they are also angled inwardly or outwardly, as the case may be. Thus, as seen in FIG. 3, the spouts 90 of all funnels lie on the same diameter, namely, the diameter defined by the circle of nozzles 58 in the table 48. Also, the spouts of the three channels are interspersed so that consecutive spouts around the circumference of the plate 60 come from different channels. By feeding different products to the different channels, multiple flavor pouches can be filled.

The funnel mouths of a series occupy substantially all of the circumference of its channel. That is, the funnel mouths are separated only by the wall thickness, with no intervening surface between them. Accordingly, all product supplied to a channel immediately falls through the channel into a funnel. Due to the arcuate extent of the funnel mouth, this allows more time for a product to make its way from a product supply hopper, through the channels, funnels, inlets and nozzles and into a pouch. This in turn permits high speed operation of the filling head, even with materials that do not exhibit good flow characteristics.

A product supply means is shown schematically at 92 in FIGS. 1 and 2, one for each channel. The product supply means meters a desired amount of its particular product to the top of its channel. The device used for this purpose can be a funnel-like hopper as shown with a gate valve therein. Alternately it could be a conveyor feed or any other device appropriate for the particular product being packaged.

Each channel accumulates only one product, although the product may contain more than one ingredient. For example, Row A could be feeding regular cocoa from a single feeder, Row B could be feeding regular cocoa with marshmallows from two feeders and Row C could be feeding sugar-free cocoa. In this case, three different products go into three consecutive pouches. The second product has two ingredients, cocoa and marshmallows. Alternately, Rows A and B could be fed with the regular cocoa while Row C gets sugar-free cocoa so two consecutive pouches would contain the same product while the third pouch has a different product. A third scenario might be all fed with cocoa, marshmallows and amaretto flavoring. This may be done with three feeders to each row. The result is all three pouches are filled with the same product. The only reason to do this is if the user changes products frequently and will be returning soon to alternate fill products. The alternate fill parts would not need to be removed and reinstalled in this instance. Another option would be to feed three products, say three different cocoas, to three rows, and add an extra ingredient such as marshmallows to each row. In three consecutive pouches there would be three different products with a common additional ingredient. It can be seen that the invention provides a degree of flexibility for the user that has not been previously available.

While a preferred form of the invention has been shown and described, it will be realized that alterations and modifications may be made thereto without departing from the scope of the following claims.

We claim:

1. In a pouch packaging machine of the type having a continuous strip of pouches moving into and out of a product filling wheel which includes a plurality of moving pouch stations for positioning the moving pouches while they are filled, opening means for opening the top edge of the pouches, a product feed tube associated with each pouch station, each product feed tube comprising an inlet and a nozzle, the product feed tube being movable in synchronous motion with the pouch station for dispensing a product through the nozzle into an open pouch while the pouch is resident at a pouch station, the improvement comprising a multiple flavor distribution deck, comprising:

a plate including a hub adapted for mounting the plate to the filling wheel such that the plate is mounted above the filling wheel and is movable therewith;

at least two channels formed in the plate by upstanding walls, the channels being open at the bottom and top thereof;

a series of arcuate funnels for each channel, the funnels being mounted on the underside of the plate, each funnel having walls defining a mouth at the upper end and a spout at the lower end, the mouth being in fluid communication with the bottom of the channel while the spout is aligned with an inlet of a product feed tube, the funnel mouths of a series occupying substantially all of its channel; and product supply means for metering a desired amount of a first product to the top of one channel and a second product to the top of the other channel.

2. The multiple flavor distribution deck of claim 1 wherein the plate is circular and the spouts of all funnels are located at the same diameter.

3. The multiple flavor distribution deck of claim 1 wherein the spouts of the funnel series are alternately arranged such that different products are supplied to successive pouches in the strip.

4. The multiple flavor distribution deck of claim 1 wherein the leading wall of the funnel mouths in one series of funnels is offset from the leading wall of the funnel mouths in the other series of funnels.

5. The multiple flavor distribution deck of claim 1 wherein there are three channels and three series of funnels.

6. The multiple flavor distribution deck of claim 1 wherein the channels are circular and the funnels occupy an arcuate portion of the channel, the funnels being arranged seriatim in the channels.

7. The multiple flavor distribution deck of claim 1 wherein the channels are separated only by one of said upstanding walls.

8. In a pouch packaging machine of the type having a product filling wheel for positioning a continuous web of moving pouches thereon while they are filled through a plurality of product feed tubes, each product feed tube comprising an inlet and a nozzle, the improvement comprising, a multiple flavor distribution deck, comprising:

a plate mounted above the filling wheel and movable therewith;

at least two channels formed in the plate by upstanding walls, the channels being always open at the bottom and top thereof;

a series of arcuate funnels for each channel, the funnels being mounted on the underside of the plate, each funnel having walls defining a mouth at the upper end and a spout at the lower end, the mouth being in fluid communication with the bottom of the channel while the spout is aligned with an inlet of a product feed tube, the funnel mouths of a series occupying substantially all of its channel, the funnel mouths and spouts being always open; and product supply means for metering a desired amount of a first product to the top of one channel and a second product to the top of the other channel, the product supply means including a hopper for each channel containing a bulk supply of the product for that channel and means for continuously releasing product into the channels at a rate which is coordinated with the speed of the filling wheel such that each hopper provides a continuous stream of product in a desired amount to its respective channel without dividing the product into discrete batches.

9. In a pouch packaging machine of the type having a product filling wheel for positioning a continuous web of moving pouches thereon while they are filled through a plurality of product feed tubes, each product feed tube comprising an inlet and a nozzle, the improvement comprising a method of supplying multiple flavor products to the pouches comprising the steps of:

forming at least two channels in a plate mounted above the filling wheel and movable therewith, the channels being always open at the bottom and top thereof;

connecting a series of arcuate funnels to each channel, each funnel having walls defining a mouth at the upper end and a spout at the lower end, the mouth being in fluid communication with the bottom of the channel while the spout is aligned with an inlet of a product feed tube, the funnel mouths of a series occupying substantially all of its channel, the funnel mouths and spouts being always open; and continuously metering a desired amount of a first product to the top of one channel and a second product to the top of the other channel, each product being supplied at a rate which is coordinated with the speed of the filling wheel such that a continuous stream of product in a desired amount is provided to its respective channel without dividing the product into discrete batches.

* * * * *